US012644198B2

(12) United States Patent
Omata et al.

(10) Patent No.: US 12,644,198 B2
(45) Date of Patent: Jun. 2, 2026

(54) PLATING APPARATUS

(71) Applicant: EBARA CORPORATION, Tokyo (JP)

(72) Inventors: Shinji Omata, Tokyo (JP); Masaki Tomita, Tokyo (JP); Kentaro Yamamoto, Tokyo (JP); Yasuyuki Masuda, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 562 days.

(21) Appl. No.: 18/026,774

(22) PCT Filed: Apr. 21, 2022

(86) PCT No.: PCT/JP2022/018410

§ 371 (c)(1),
(2) Date: Mar. 16, 2023

(87) PCT Pub. No.: WO2023/203720

PCT Pub. Date: Oct. 26, 2023

(65) Prior Publication Data

US 2024/0318346 A1 Sep. 26, 2024

(51) Int. Cl.

| | |
|---|---|
| ***C25D 17/00*** | (2006.01) |
| ***C25D 17/02*** | (2006.01) |
| ***C25D 17/06*** | (2006.01) |
| ***C25D 21/04*** | (2006.01) |

(52) U.S. Cl.

CPC ..... *C25D 17/002* (2013.01); *C25D 17/02* (2013.01); *C25D 17/06* (2013.01); *C25D 21/04* (2013.01)

(58) Field of Classification Search

CPC ..... C25D 17/002; C25D 17/02; C25D 17/06; C25D 21/04

See application file for complete search history.

(56) References Cited

U.S. PATENT DOCUMENTS

| | | | |
|---|---|---|---|
| 6,964,792 | B1 | 11/2005 | Mayer et al. |
| 2023/0167574 | A1 | 6/2023 | Hiwatashi et al. |

FOREIGN PATENT DOCUMENTS

| | | | |
|---|---|---|---|
| JP | 2002-275693 | A | 9/2002 |
| JP | 2008-019496 | A | 1/2008 |
| JP | 6951609 | B1 | 10/2021 |
| JP | 7057869 | B1 | 4/2022 |
| JP | 2002-146599 | A | 5/2022 |

*Primary Examiner* — Zulmariam Mendez
(74) *Attorney, Agent, or Firm* — BakerHostetler

(57) ABSTRACT

Provided is a technique that ensures suppressing deterioration of plating quality of a substrate due to gas bubbles at an anode.

A plating module 400 includes a plating tank 10 configured to house a plating solution, an anode 13 arranged in the plating tank 10, a substrate holder 20 configured to hold a substrate WF with a surface to be plated facing downward so as to be opposed to the anode 13, a membrane module 40 that includes a first membrane 41 partitioning an inside of the plating tank 10 into an anode chamber 11 and a cathode chamber 12 and a second membrane 42 arranged between the first membrane 41 and the anode 13, and a pipe member 31 communicating between a first region R1 below the anode 13 in the plating tank 10 and a second region R2 between the first membrane 41 and the second membrane 42.

7 Claims, 14 Drawing Sheets

1000

PLATING APPARATUS

CROSS-REFERENCE TO RELATED APPLICATIONS

This application is a U.S. national phase application of International Patent Application No. PCT/JP2022/018410 filed Apr. 21, 2022, which is incorporated by reference in its entirety for any and all purposes.

TECHNICAL FIELD

This application relates to a plating apparatus.

BACKGROUND ART

There has been known a cup type electroplating apparatus as one example of a plating apparatus. The cup type electroplating apparatus includes a plating tank that houses a plating solution, an anode arranged in the plating tank, and a substrate holder that holds a substrate to be opposed to the anode with a surface to be plated facing downward. The electroplating apparatus deposits a conductive film on the surface to be plated of the substrate by immersing the substrate in the plating solution and applying a voltage between the substrate and the anode.

For example, as disclosed in PTL 1, it has been known that a cup type electroplating apparatus includes a membrane inside a plating tank. This membrane partitions the inside of the plating tank into an anode chamber where an anode is arranged and a cathode chamber where a substrate is arranged.

CITATION LIST

Patent Literature

PTL 1: Japanese Unexamined Patent Application Publication No. 2008-19496

SUMMARY OF INVENTION

Technical Problem

In the cup type plating apparatus with the membrane as described above, gas bubbles are generated at the anode and rise upward in the plating solution, thereby accumulating and remaining on a lower surface of the membrane in some cases. In such a case, due to the gas bubbles remaining on the lower surface of the membrane, plating quality of the substrate possibly deteriorates.

In this respect, it is conceivable that a membrane on which the gas bubbles are less likely to remain is additionally disposed between the membrane and the anode. In such a case, it is necessary to fill a region between the membrane and the added membrane with the plating solution. In order to inject the plating solution into the region between these membranes, it is conceivable that a flow passage, such as a hole, is formed in the added membrane, but in such a case, the gas bubbles may enter the region between the membranes from this flow passage to possibly remain on the lower surface of the membrane.

Therefore, one of the objects of this application is to provide a technique that ensures suppressing deterioration of plating quality of a substrate due to gas bubbles at an anode.

Solution to Problem

According to one embodiment, a plating apparatus is disclosed and the plating apparatus includes: a plating tank configured to house a plating solution; an anode arranged in the plating tank; a substrate holder configured to hold a substrate with a surface to be plated facing downward so as to be opposed to the anode; a membrane module that includes a first membrane partitioning an inside of the plating tank into an anode chamber and a cathode chamber and a second membrane arranged between the first membrane and the anode; and a pipe member communicating between a first region below the anode in the plating tank and a second region between the first membrane and the second membrane.

DESCRIPTION OF EMBODIMENTS

Figure 1:
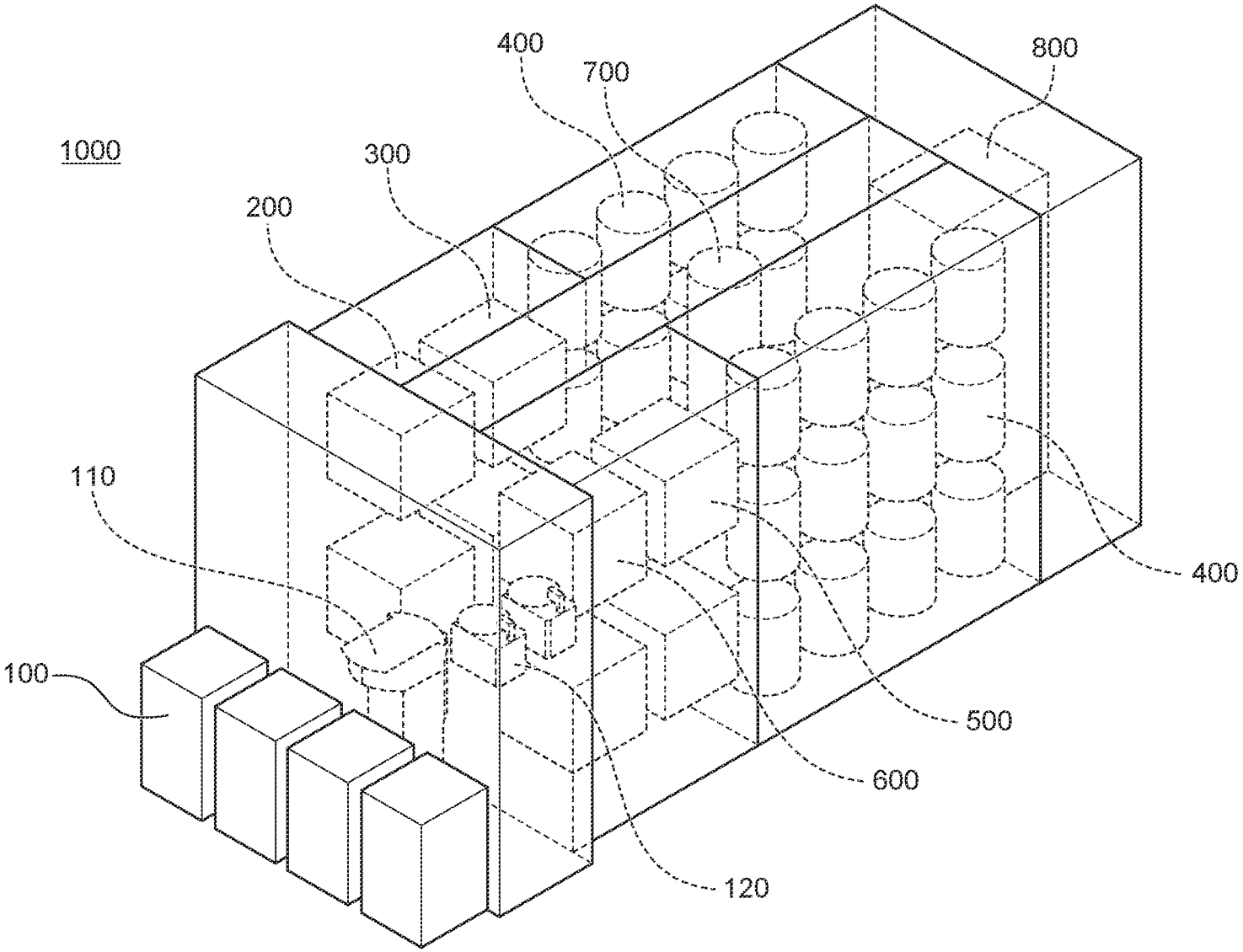
FIG. 1 is a perspective view illustrating an overall configuration of a plating apparatus of an embodiment.

The following describes an embodiment of the present invention with reference to the drawings. In the drawings described below, identical reference numerals are attached to identical or equivalent components, and the overlapping description is omitted.

<Overall Configuration of Plating Apparatus>

Figure 2:
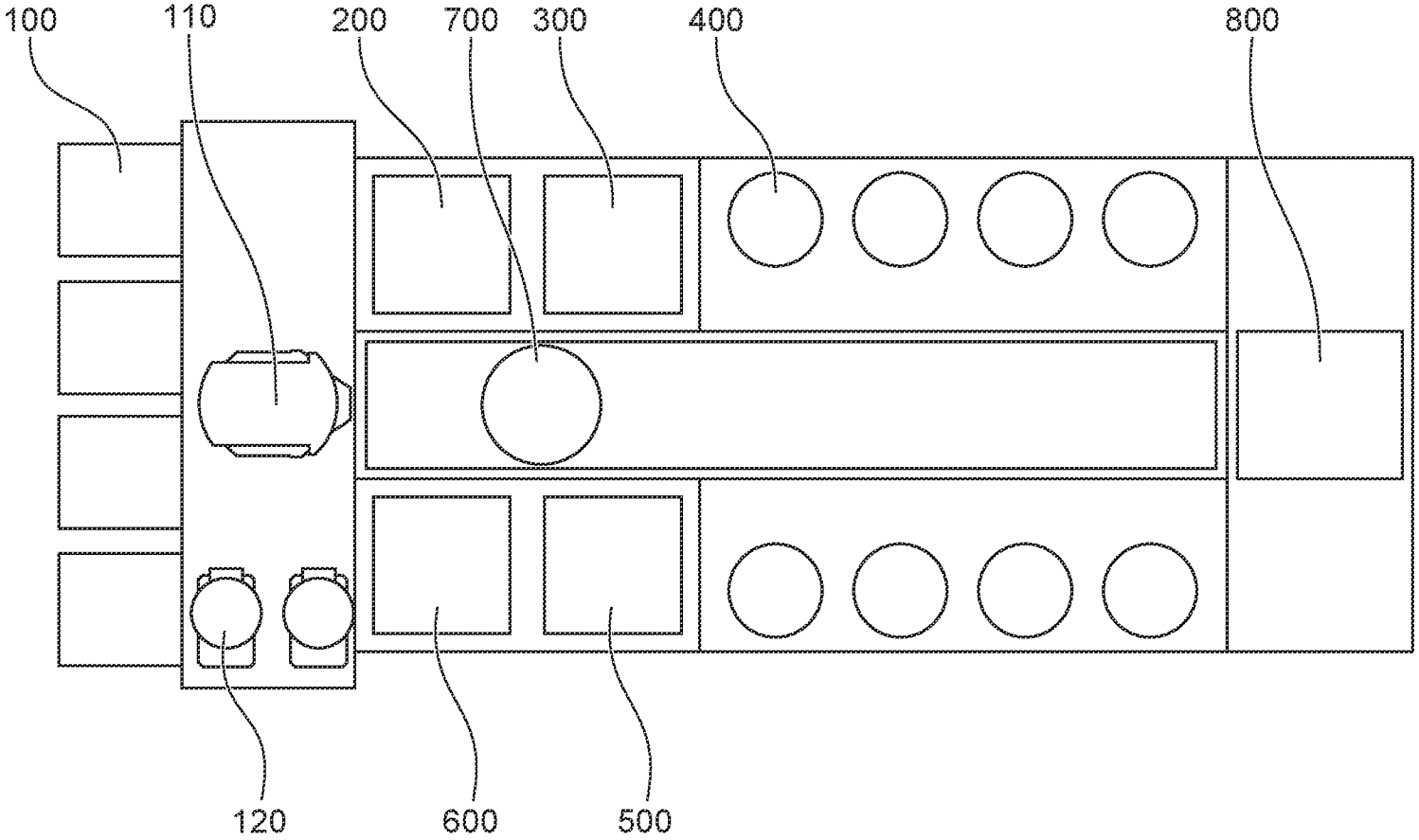
FIG. 2 is a plan view illustrating the overall configuration of the plating apparatus of the embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load ports 100, the aligners 120, the pre-wet modules 200, and the spin rinse dryers 600. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the pre-wet module 200.

The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer robot 110 receives the substrate from the spin rinse dryer 600 and transfers the substrate, on which the drying process is performed, to the cassette at the load port 100. Finally, the cassette housing the substrate is unloaded from the load port 100.

<Configuration of Plating Module>

Next, a configuration of the plating modules 400 will be described. Since the 24 plating modules 400 according to the embodiment have the identical configuration, only one plating module 400 will be described.

Figure 3:
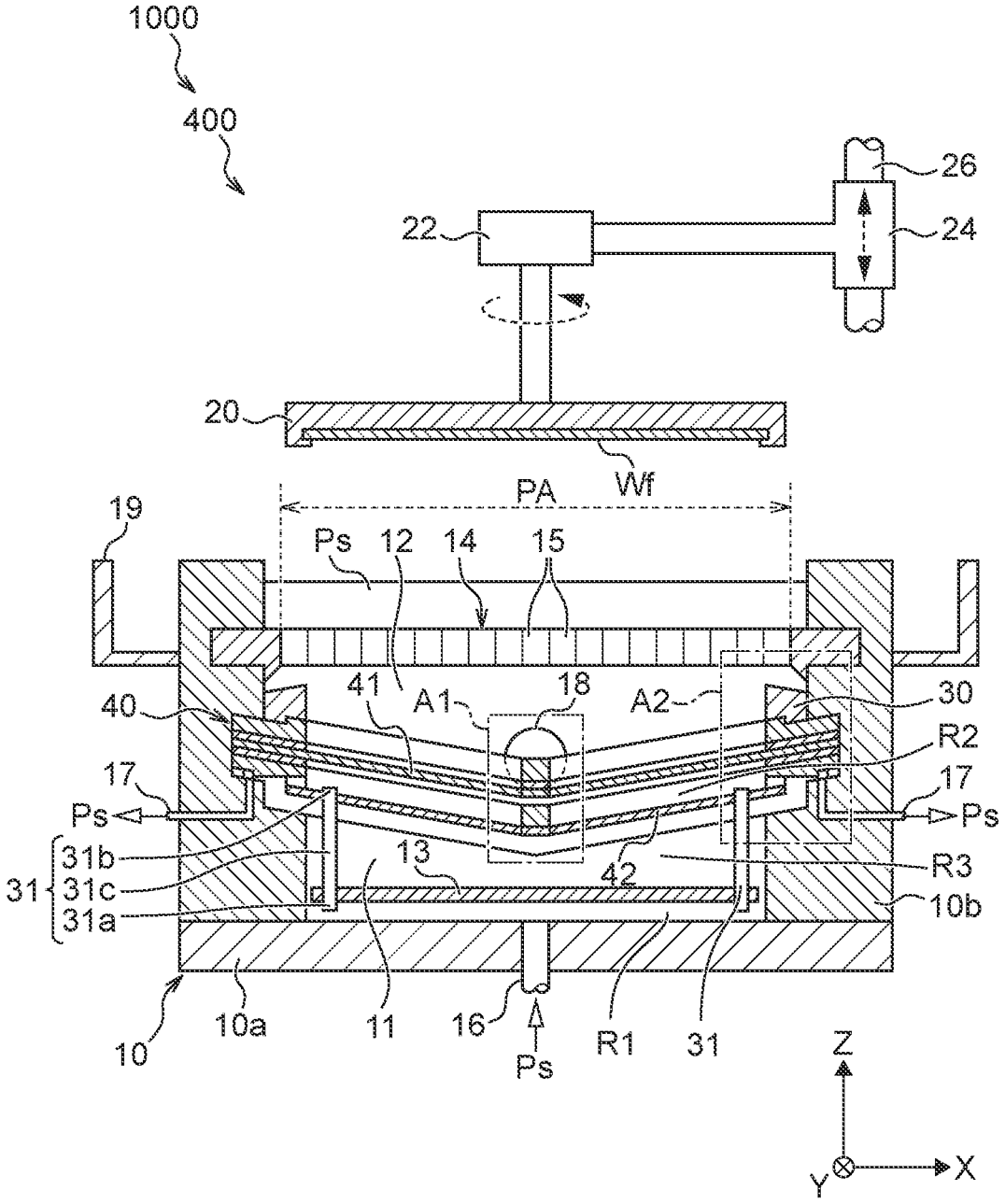
FIG. 3 is a drawing schematically illustrating a configuration of a plating module according to the embodiment.

FIG. 3 is a drawing schematically illustrating the configuration of one plating module 400 in the plating apparatus 1000 according to this embodiment. The plating apparatus 1000 according to this embodiment is a cup type plating apparatus. The plating module 400 of the plating apparatus 1000 according to this embodiment includes a plating tank 10, a substrate holder 20, a rotation mechanism 22, an elevating mechanism 24, an electric field adjusting block 30, and a membrane module 40.

The plating tank 10 is configured of a container with a bottom having an opening on an upper side. Specifically, the plating tank 10 has a bottom wall 10*a* and a side wall 10*b* extending upward from an outer edge of the bottom wall 10*a*, and an upper portion of the side wall 10*b* is open. Although the shape of the side wall 10*b* of the plating tank 10 is not particularly limited, the side wall 10*b* according to this embodiment has a cylindrical shape as an example. In the inside of the plating tank 10, a plating solution Ps is accumulated. On an outer side of the side wall 10*b* of the plating tank 10, an overflow tank 19 for accumulating the plating solution Ps overflowing from the upper end of the side wall 10*b* is arranged.

It is only necessary for the plating solution Ps to be a solution including ions of a metallic element constituting a plating film, and a specific example of the plating solution Ps is not particularly limited. In this embodiment, a copper plating process is used as an example of the plating process, and a copper sulfate solution is used as an example of the plating solution Ps.

Further, in this embodiment, a predetermined plating additive is included in the plating solution Ps. As a specific example of the predetermined plating additive, in this embodiment, a "nonionic plating additive" is used. The nonionic plating additive means an additive that does not exhibit an ionic character in the plating solution Ps.

In the inside of the plating tank 10, an anode 13 in a circular plate shape is arranged. The anode 13 is arranged so as to extend in the horizontal direction. A specific type of the anode 13 is not particularly limited, and it may be an insoluble anode or may be a soluble anode. In this embodiment, an insoluble anode is used as an example of the anode 13. A specific type of the insoluble anode is not particularly limited, and platinum, iridium oxide, and the like can be used. Between the anode 13 and a second membrane 42 of the membrane module 40 described later, an anode mask may be arranged.

In a cathode chamber 12 described later inside the plating tank 10, an ionically resistive element 14 is arranged. Specifically, the ionically resistive element 14 is disposed at a position above the membrane module 40 in the cathode chamber 12 and below a substrate Wf. The ionically resistive element 14 is a member that can be a resistance to movement of ions in the cathode chamber 12 and is disposed to ensure homogenization of an electric field formed between the anode 13 and the substrate Wf.

The ionically resistive element 14 is configured of a plate member having a plurality of through-holes 15 disposed so as to pass through the lower surface and the upper surface of the ionically resistive element 14. The plurality of through-holes 15 are disposed at a part of a punching area PA (which is a circular area in the top view) of the ionically resistive element 14. While a specific material of the ionically resistive element 14 is not particularly limited, in this embodiment, a resin, such as polyetheretherketone, is used as an example.

The plating module 400 has the ionically resistive element 14, thereby ensuring homogenization of a film thickness of a plating film (plated layer) formed on the substrate Wf.

The electric field adjusting block 30 is configured of a ring-shaped member. The electric field adjusting block 30 is arranged below the ionically resistive element 14 in the cathode chamber 12 and above the membrane module 40. Specifically, the electric field adjusting block according to this embodiment is arranged on the upper surface of a first supporting member 43 described later.

Figure 13:
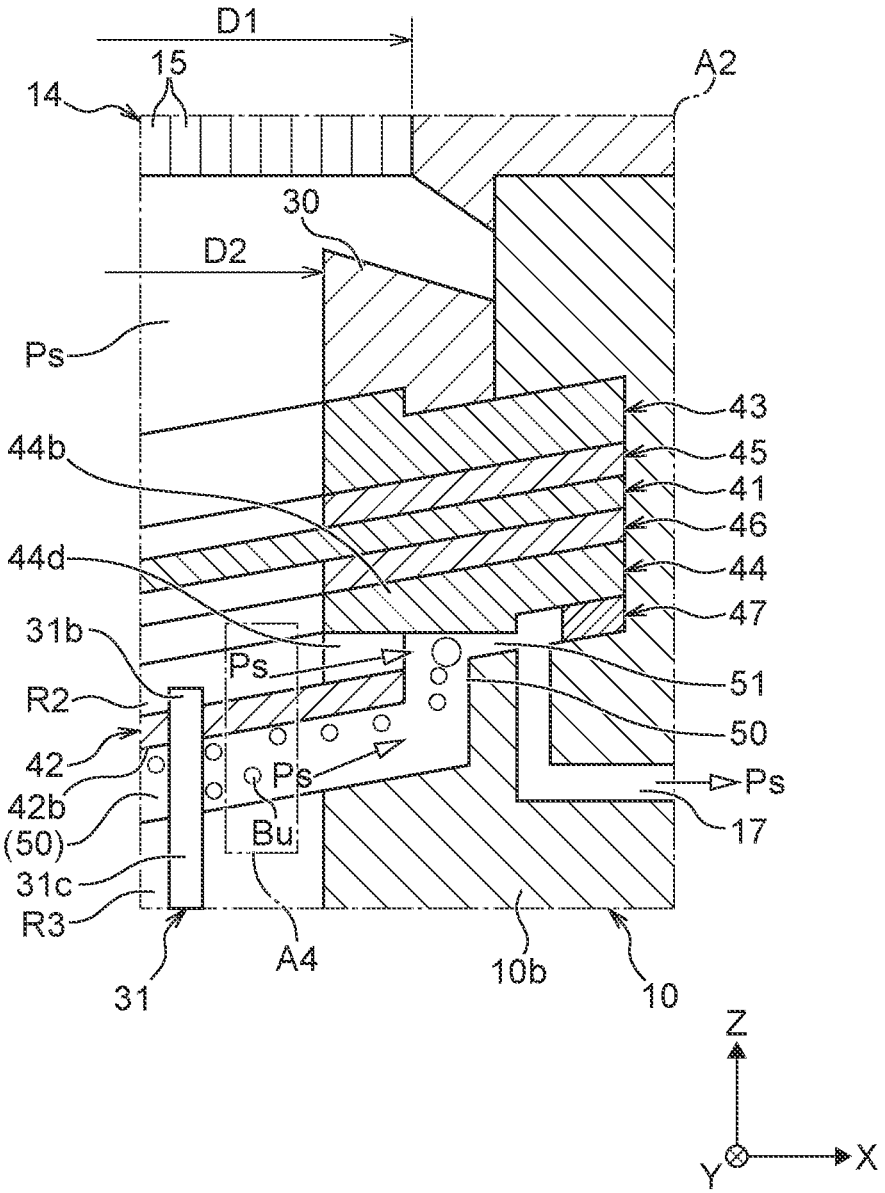
FIG. 13 is a schematic enlarged cross-sectional view of a part A2 in FIG. 3.

As illustrated in FIG. 13 described later, an inner diameter D2 of an inner peripheral wall of the electric field adjusting block 30 has a value smaller than an outer diameter D1 of the punching area PA of the ionically resistive element 14. In other words, the inner peripheral wall of the electric field adjusting block 30 is positioned on an inner side in the radial direction of the ionically resistive element 14 with respect to the through-hole 15 positioned on the outermost side in the radial direction of the ionically resistive element 14.

The electric field adjusting block 30 has a function of adjusting the electric field in the cathode chamber 12. Specifically, the electric field adjusting block 30 suppresses concentration of the electric field on an outer edge of the substrate Wf and adjusts the electric field in the cathode chamber 12 such that the film thickness of the plating film formed on the substrate Wf is homogenized. While a specific material of the electric field adjusting block 30 is not particularly limited, in this embodiment, a resin, such as polyetheretherketone, is used as an example.

Since the electric field in the cathode chamber 12 can be adjusted by including the electric field adjusting block 30 in the plating module 400, homogenization of the film thickness of the plating film can be effectively ensured.

Note that it is preferred to preliminarily prepare a plurality of kinds of electric field adjusting blocks 30 having different inner diameters D2. In this case, it is only necessary to select the electric field adjusting block 30 having a desired inner diameter D2 among the plurality of kinds of electric field adjusting blocks 30 and to arrange the selected electric field adjusting block 30 in the plating tank 10.

The ionically resistive element 14 or the electric field adjusting block 30 described above are not essential members in this embodiment, and the plating module 400 can be configured not to include these members.

With reference to FIG. 3, inside the plating tank 10, the membrane module 40 is arranged at a position between the anode 13 and the substrate Wf (cathode) (specifically, at a position between the anode 13 and the ionically resistive element 14 in this embodiment). Inside the plating tank 10, a region below a first membrane 38 described later of the membrane module 40 is referred to as an anode chamber 11, and a region above the first membrane 38 is referred to as the cathode chamber 12. The above-described anode 13 is arranged in the anode chamber 11. Details of the membrane module 40 will be described later.

The substrate holder 20 holds the substrate Wf as the cathode such that a surface to be plated (lower surface) of the substrate Wf is opposed to the anode 13. The substrate holder 20 is connected to the rotation mechanism 22. The rotation mechanism 22 is a mechanism for rotating the substrate holder 20. The rotation mechanism 22 is connected to the elevating mechanism 24. The elevating mechanism 24 is supported by a support pillar 26 extending in the vertical direction. The elevating mechanism 24 is a mechanism for moving up and down the substrate holder 20 and the rotation mechanism 22. The substrate Wf and the anode 13 are electrically connected to an energization device (not illustrated). The energization device is a device for flowing electricity between the substrate Wf and the anode 13 in performing the plating process.

In the plating tank 10, an anode chamber supply port 16 for supplying the plating solution Ps to the anode chamber 11 and anode chamber discharge ports 17 for discharging the plating solution Ps from the anode chamber 11 to an outside of the plating tank 10 are disposed. The anode chamber supply port 16 according to this embodiment is arranged in the bottom wall 10*a* of the plating tank 10 as an example. The anode chamber discharge ports 17 are arranged in the side wall 10*b* of the plating tank 10 as an example. The anode chamber discharge ports 17 are disposed at two positions in the plating tank 10. Details of the anode chamber discharge port 17 will be described later.

The plating solution Ps discharged from the anode chamber discharge ports 17 is temporarily accumulated in a reservoir tank for the anode chamber, and then, supplied from the anode chamber supply port 16 to the anode chamber 11 again.

In the plating tank 10, a supply/drain port 18 for the cathode chamber 12 is disposed. The supply/drain port 18 is a combination of a "supply port of the plating solution Ps for the cathode chamber 12" and a "drain port of the plating solution Ps for the cathode chamber 12".

That is, when the plating solution Ps is supplied to the cathode chamber 12, the supply/drain port 18 functions as the "supply port of the plating solution Ps for the cathode chamber 12", and the plating solution Ps is supplied from the supply/drain port 18 to the cathode chamber 12. On the other hand, when the plating solution Ps is discharged from the cathode chamber 12, the supply/drain port 18 functions as the "drain port of the plating solution Ps for the cathode chamber 12", and the plating solution Ps in the cathode chamber 12 is discharged from the supply/drain port 18.

Specifically, a flow passage switching valve (not illustrated) is connected to the supply/drain port 18 according to this embodiment. By switching a flow passage by the flow passage switching valve, the supply/drain port 18 selectively performs supplying the plating solution Ps to the cathode chamber 12 and discharging the plating solution Ps in the cathode chamber 12 to the outside of the plating tank 10.

Figure 4:
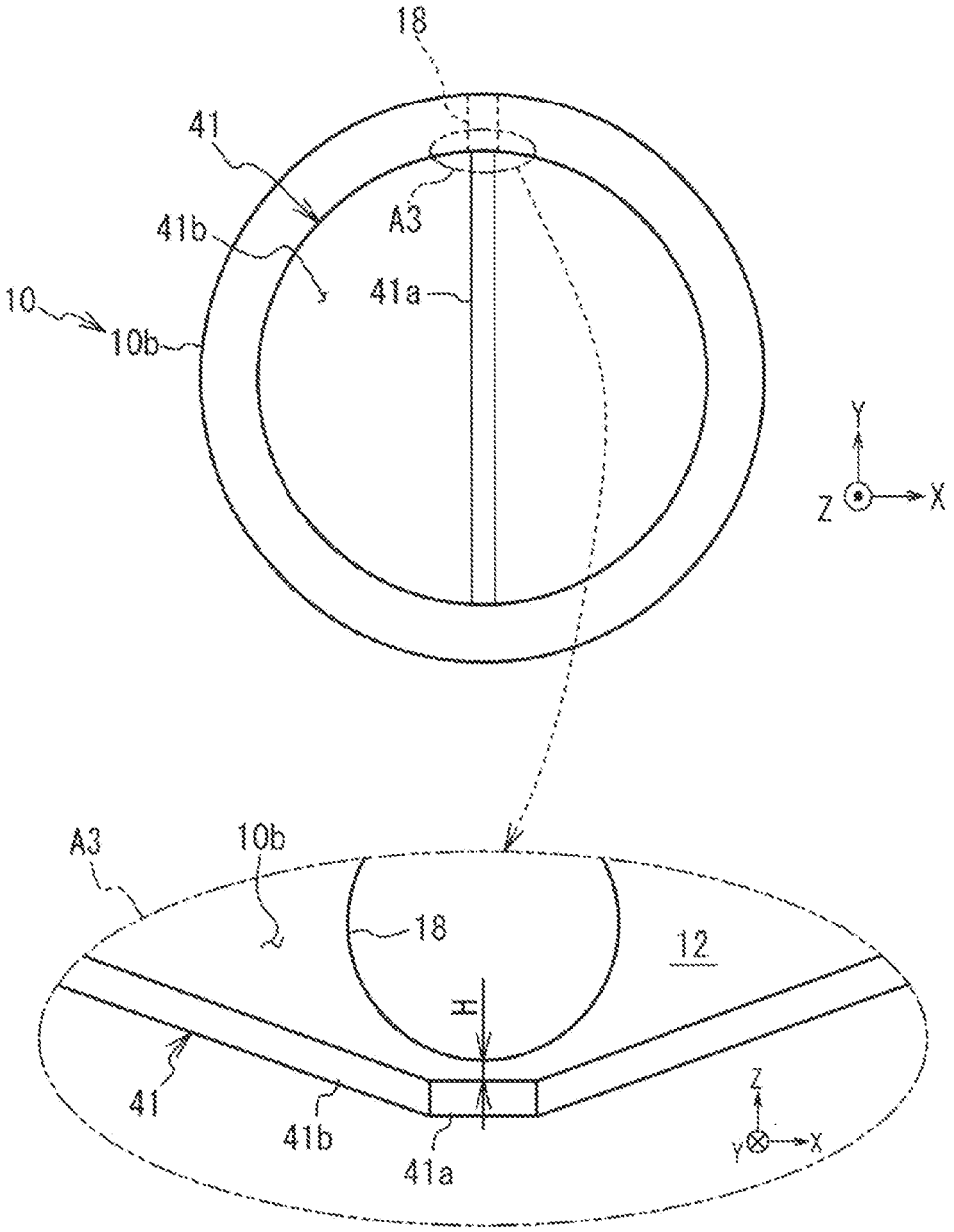
FIG. 4 is a schematic diagram for describing details of a supply/drain port according to the embodiment.

FIG. 4 is a schematic diagram for describing details of the supply/drain port 18. Specifically, in FIG. 4, a schematic top view of the plating tank 10 is illustrated, and in a part (part A3) of FIG. 4, a schematic front view of a peripheral configuration of the supply/drain port 18 is also illustrated. In FIG. 4, illustration of the ionically resistive element 14, the electric field adjusting block 30, and the first supporting member 43 and a first sealing member 45 that are described later is omitted.

As illustrated in FIG. 4, the supply/drain port 18 according to this embodiment is disposed in the side wall 10*b* of the plating tank 10. The supply/drain port 18 is disposed such that a height (H) from an extending portion 41*a* of the first membrane 38 described later to the supply/drain port 18 is within 20 mm. That is, the height (H) may be 0 mm (in this case, the supply/drain port 18 is arranged immediately above the extending portion 41*a* of the first membrane 38), may be 20 mm, or may be an arbitrary value selected from a range larger than 0 mm and smaller than 20 mm.

With this configuration, the plating solution Ps in the cathode chamber 12 can be easily discharged from the cathode chamber 12.

Note that the configuration of the supply/drain port 18 is not limited to the above-described configuration. To give another example, the plating module 400 may individually include a "supply port of the plating solution Ps for the cathode chamber 12" and a "drain port of the plating solution Ps for the cathode chamber 12" instead of the supply/drain port 18.

When the plating process is performed on the substrate Wf, first, the rotation mechanism 22 rotates the substrate holder 20 while the elevating mechanism 24 moves the substrate holder 20 downward to immerse the substrate Wf in the plating solution Ps in the plating tank 10 (the plating solution Ps in the cathode chamber 12). Next, electricity flows between the anode 13 and the substrate Wf by the energization device. This forms the plating film on the surface to be plated of the substrate Wf.

In performing the plating process on the substrate Wf, the supply/drain port 18 does not fulfill the function as the "drain port of the plating solution Ps for the cathode chamber 12". Specifically, in performing the plating process, the plating solution Ps in the cathode chamber 12 overflows from the upper end of the side wall 10*b* of the plating tank 10 and is temporarily accumulated in the overflow tank 19. After completion of the plating process, when the plating solution Ps in the cathode chamber 12 is discharged from the cathode chamber 12 to empty the plating solution Ps out of the cathode chamber 12, the supply/drain port 18 enters a valve-opening state and functions as the "drain port of the plating solution Ps for the cathode chamber 12" to discharge the plating solution Ps from the supply/drain port 18.

In the cup type plating apparatus 1000 as described in this embodiment, gas bubbles Bu (this reference numeral is mentioned in FIG. 13 described later) are possibly generated in the anode chamber 11 for some reason. Specifically, as described in this embodiment, when an insoluble anode is used as the anode 13, oxygen ($O_2$) is generated in the anode chamber 11 based on the following reaction equation in performing the plating process (in applying current). In this case, the generated oxygen becomes the gas bubbles Bu.

$$2H2O \rightarrow O2+4H++4e-$$

As described above, in a case where the gas bubbles Bu are generated in the anode chamber 11, if the gas bubbles Bu remain entirely on the lower surface of the membrane module 40 (specifically, the lower surface of the second membrane 42 described later), the gas bubbles Bu possibly cut off the electric field. In this case, the plating quality of the substrate Wf possibly deteriorates. Therefore, in this embodiment, a technique that will be described in the following is used to deal with such a problem.

Figure 5:
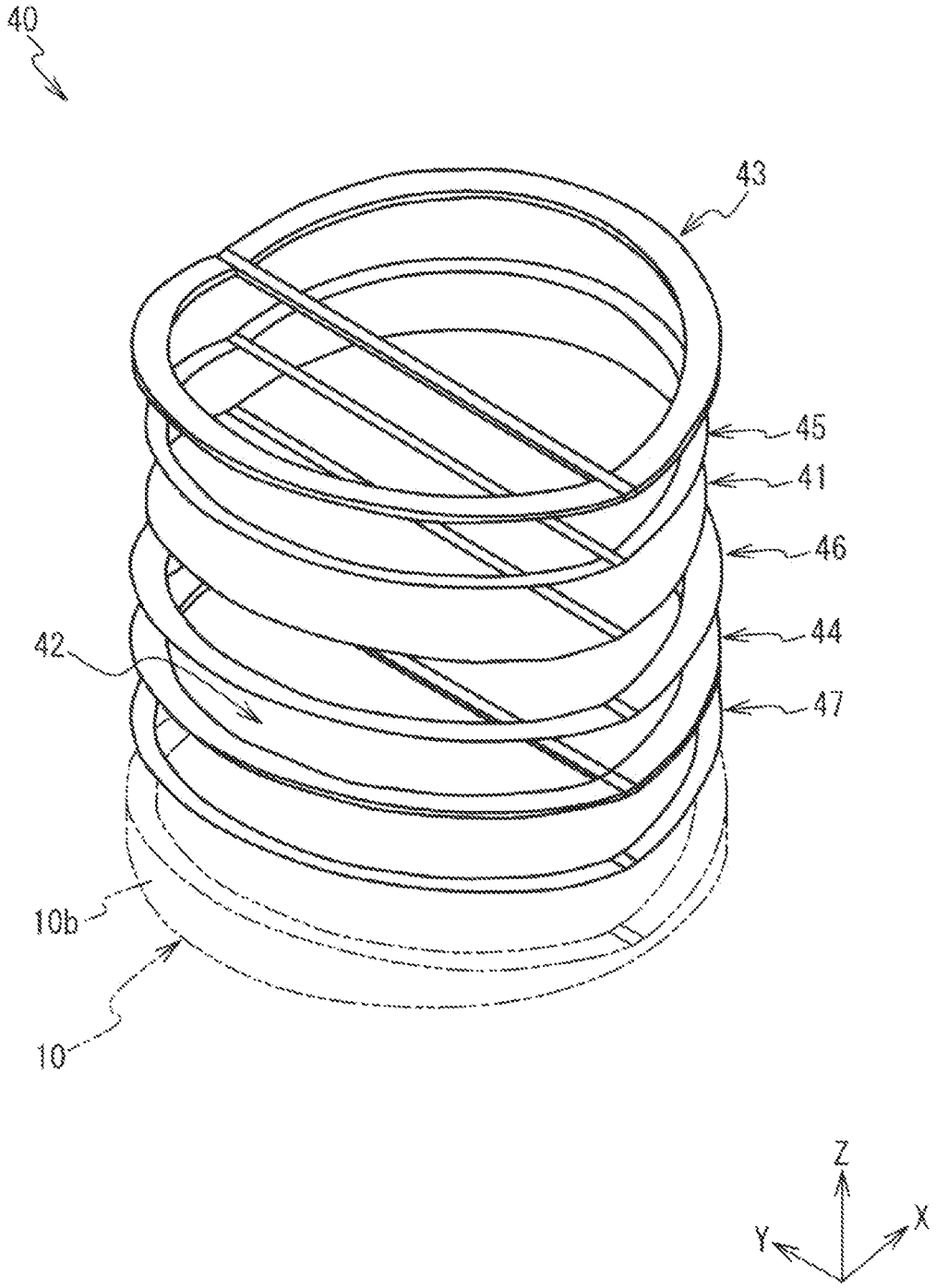
FIG. 5 is a schematic exploded perspective view of a membrane module according to the embodiment.
Figure 6:
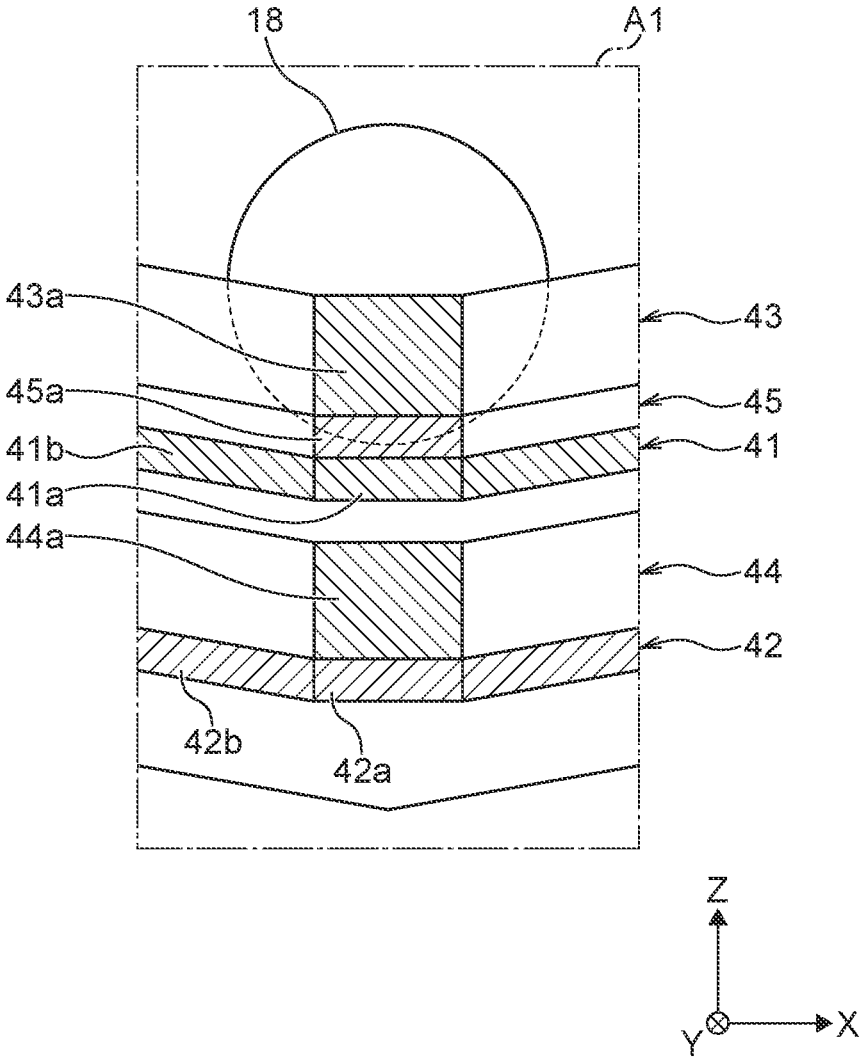
FIG. 6 is a schematic enlarged cross-sectional view of a part A1 in FIG. 3.

FIG. 5 is a schematic exploded perspective view of the membrane module 40. FIG. 6 is a schematic enlarged cross-sectional view of a part A1 of FIG. 3. The membrane module 40 according to this embodiment includes the first membrane 38, the second membrane 42, the first supporting member 43 (that is, a "first membrane supporting member"), a second supporting member 44 (that is, a "second membrane supporting member"), the first sealing member 45, a second sealing member 46, and a third sealing member 47. These constituting members of the membrane module 40 are secured to a predetermined position of the side wall 10*b* of the plating tank 10 (that is, a secured position to which the membrane module 40 is secured) using a fastening member, such as a bolt.

Figure 7:
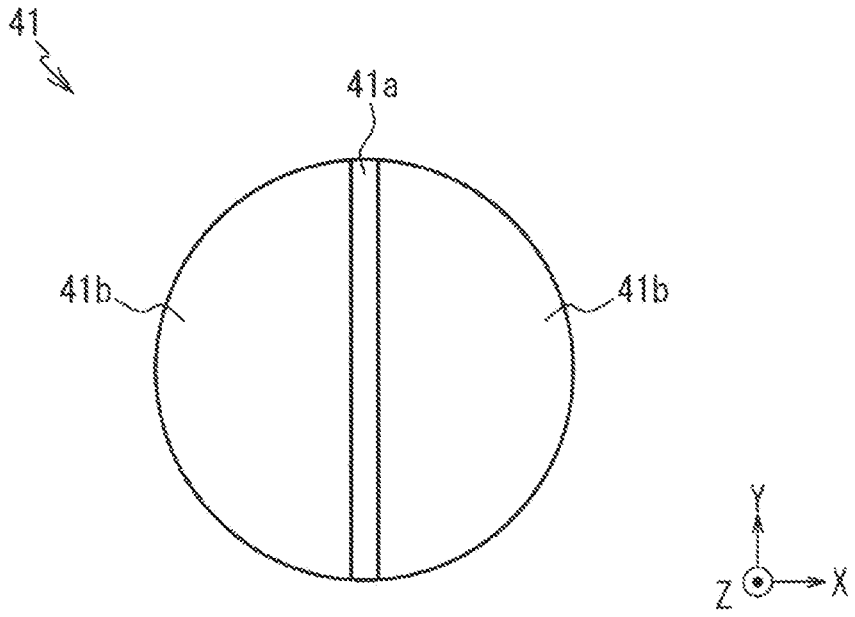
FIG. 7 is a schematic top view of a first membrane according to the embodiment.
Figure 8:
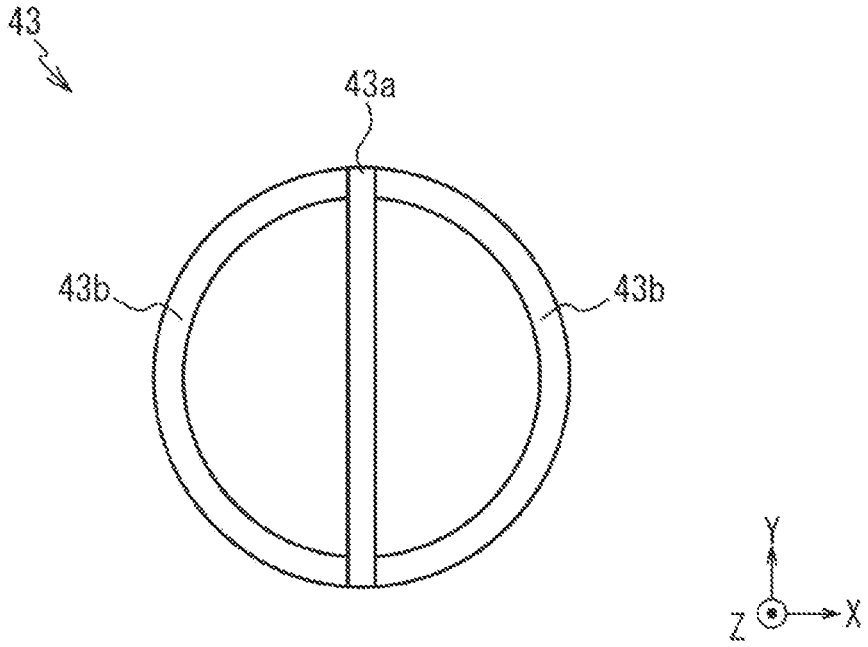
FIG. 8 is a schematic top view of a first supporting member according to the embodiment.
Figure 9:
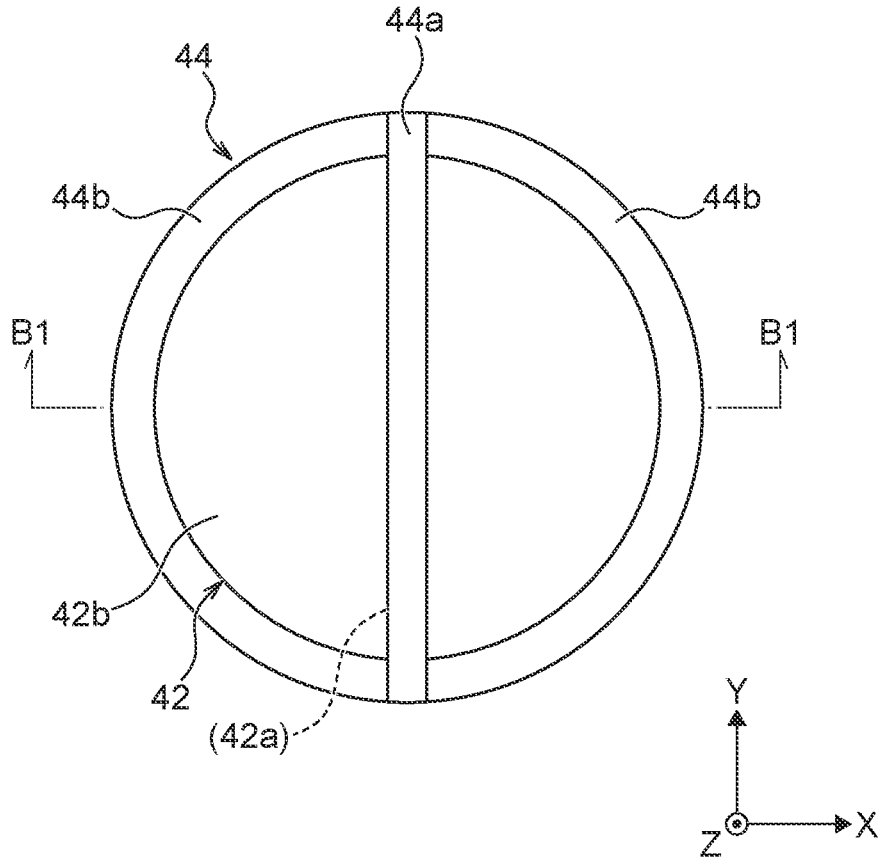
FIG. 9 is a schematic top view of a second membrane and a second supporting member according to the embodiment.
Figure 10:
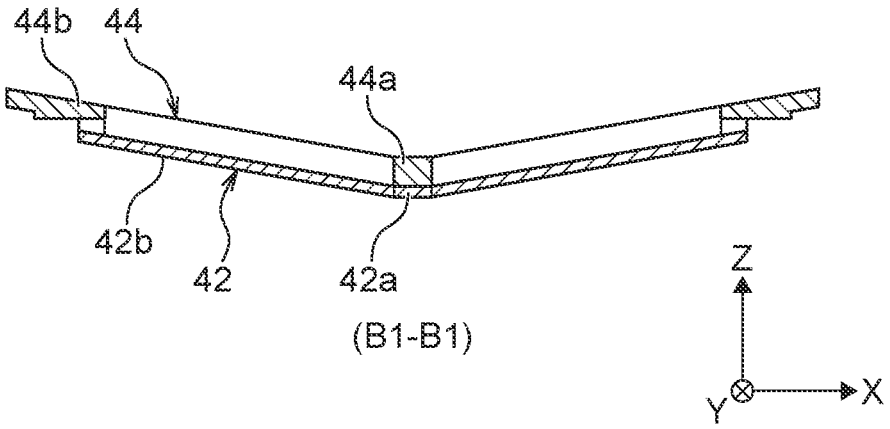
FIG. 10 is a cross-sectional view schematically illustrating a cross-sectional surface taken along a line B1-B1 in FIG. 9.
Figure 11:
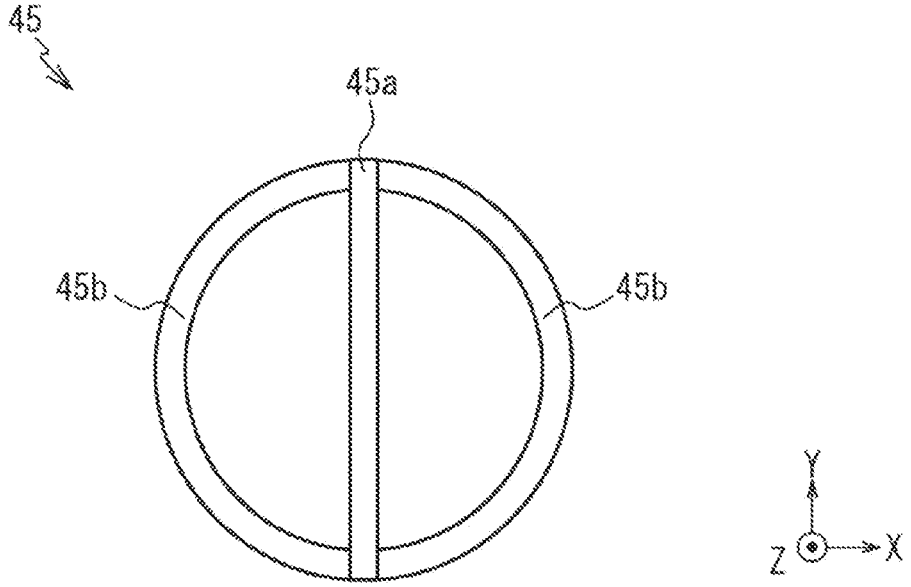
FIG. 11 is a schematic top view of a first sealing member according to the embodiment.
Figure 12:
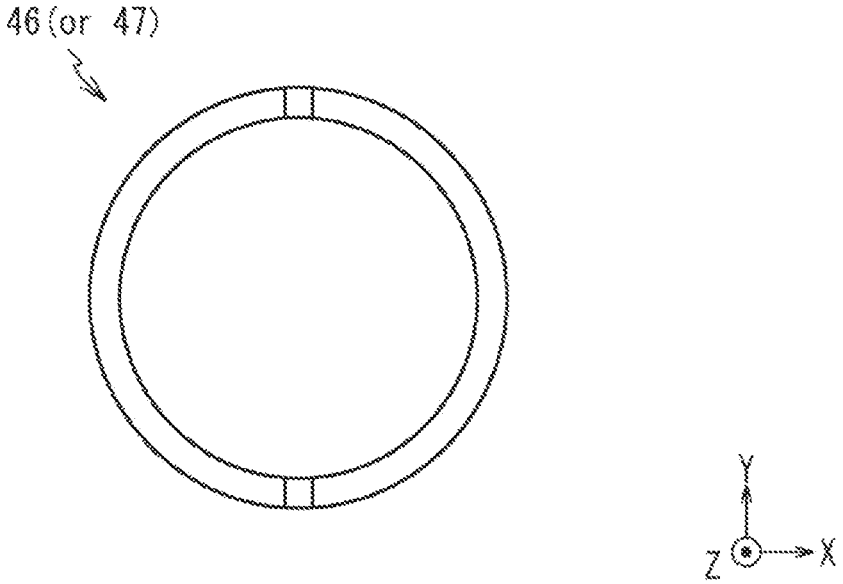
FIG. 12 is a schematic top view of a second sealing member or a third sealing member according to the embodiment.

FIG. 7 is a schematic top view of the first membrane 38. FIG. 8 is a schematic top view of the first supporting member 43. FIG. 9 is a schematic top view of the second membrane 42 and the second supporting member 44. FIG. 10 is a cross-sectional view schematically illustrating a cross-sectional surface taken along a line B1-B1 of FIG. 9. FIG. 11 is a schematic top view of the first sealing member 45. FIG. 12 is a schematic top view of the second sealing member 46 (or the third sealing member 47). FIG. 13 is a schematic enlarged cross-sectional view of a part A2 of FIG. 3.

The first membrane 38 is a membrane that partitions the inside of the plating tank 10 into the anode chamber 11 where the anode 13 is arranged and the cathode chamber 12 where the substrate Wf is arranged. Specifically, the first membrane 38 is a membrane configured to allow ion species (which include metal ions) included in the plating solution Ps to pass through the first membrane 38 and restrict a nonionic plating additive included in the plating solution Ps from passing through the first membrane 38. Specifically, the first membrane 38 has a plurality of fine holes (micropores) (illustration of the micropores is omitted). An average diameter of the plurality of holes is a size of nanometer (that is, a size of 1 nm or more and 999 nm or less). This allows the ion species (which have a size of nanometer) including metal ions to pass through the plurality of micropores of the first membrane 38 while restricting the nonionic plating additive (which has a size larger than nanometer) from passing through the plurality of micropores of the first membrane 38. As the first membrane 38, for example, an ion exchange membrane can be used. Examples of specific product names of the first membrane 38 include, for example, Nafion membrane manufactured by The Chemours Company.

As described in this embodiment, by including the first membrane 38 in the plating module 400, movement of the nonionic plating additive included in the plating solution Ps in the cathode chamber 12 to the anode chamber 11 can be suppressed. This can ensure reduction in consumption amount of the plating additive in the cathode chamber 12.

As illustrated in FIG. 7, the first membrane 38 includes the extending portion 41*a* and inclined portions 41*b*. The extending portion 41*a* extends in the horizontal direction. Specifically, the extending portion 41*a* extends in the horizontal direction (Y-direction as an example) while passing through the center of the anode chamber 11. The extending portion 41*a* is configured of a surface having a predetermined width (length in the X-direction).

The inclined portions 41*b* extend from the extending portion 41*a* as a starting point to one side (X-direction side) and the other side (−X-direction side) in directions away from the extending portion 41*a* and incline so as to be positioned upward as separating from the extending portion 41*a*. As a result, the first membrane 38 according to this embodiment has a "V-shaped" appearance shape in the front view (when viewed from the Y-direction). An outer edge of the inclined portion 41*b* according to this embodiment has an arc shape. Specifically, the outer edge of the inclined portion 41*b* has an arc shape in which parts of the outer edge are connected to both ends of the extending portion 41*a* (the end portion on the Y-direction side and the end portion on the −Y-direction side). As a result, the first membrane 38 has an approximately circular shape in the top view.

To give an example of an inclination angle relative to the horizontal direction of the inclined portions 41*b* of the first membrane 38, for example, a value of 2 degrees or more can be used as the inclination angle, and specifically, a value of 2 degrees or more and 45 degrees or less can be used.

As illustrated in FIG. 8, the first supporting member 43 is a member for supporting the first membrane 38. Specifically, the first supporting member 43 includes a first portion 43*a* that supports the extending portion 41*a* of the first membrane 38 and a second portion 43*b* that supports the outer edges of the inclined portions 41*b* of the first membrane 38. The first portion 43*a* extends in the horizontal direction. Specifically, the first portion 43*a* extends in the horizontal direction (Y-direction as an example) while passing through the center of the anode chamber 11. The second portion 43*b* is configured of a circular member and inclines so as to be positioned upward as separating from the first portion 43*a*.

The first portion 43*a* according to this embodiment is positioned above the first membrane 38 and supports the first membrane 38 from the upper side.

As illustrated in FIG. 5, the first sealing member 45 is a sealing member that is sandwiched between the first membrane 38 and the first supporting member 43. Thus, by arranging the first sealing member 45 between the first membrane 38 and the first supporting member 43, the first membrane 38 and the first supporting member 43 are in a mutually non-contact state.

As illustrated in FIG. 11, the first sealing member 45 includes an extending sealing portion 45*a* and an outer edge sealing portion 45*b*. The extending sealing portion 45*a* extends in the horizontal direction and is sandwiched between the extending portion 41*a* of the first membrane 38 and the first portion 43*a* of the first supporting member 43. The outer edge sealing portion 45*b* is sandwiched between the outer edges of the inclined portions 41*b* of the first membrane 38 and the second portion 43*b* of the first supporting member 43.

With reference to FIG. 5 and FIG. 6, the second membrane 42 is arranged between the first membrane 38 and the anode 13, that is, at a position below the first membrane 38 and above the anode 13 without contacting the first membrane 38. This sections the inside of the plating tank 10 (the inside of the anode chamber 11) into a region below the anode 13, a region between the first membrane 38 and the second membrane 42, and a region between the second membrane 42 and the anode 13. Hereinafter, the region below the anode 13 is referred to as a "first region R1", the region between the first membrane 38 and the second membrane 42 is referred to as a "second region R2", and the region between the second membrane 42 and the anode 13 is referred to as a "third region R3".

With reference to FIG. 5, FIG. 6, FIG. 9, and FIG. 10, the second membrane 42 according to this embodiment is bonded on the second supporting member 44. Specifically, the second membrane 42 according to this embodiment is bonded on the lower surface of the second supporting member 44 as an example.

The second membrane 42 is a membrane configured to allow the ion species (ion species including metal ions) included in the plating solution Ps to pass through the second membrane 42 and restrict the gas bubbles Bu from passing through the second membrane 42. Specifically, the second membrane 42 has a plurality of micropores (illustration of the micropores is omitted). An average diameter of the plurality of micropores is a size of nanometer. This allows the ion species including metal ions to pass through the micropores of the second membrane 42 while restricting the gas bubbles Bu (which have a size larger than nanometer) from passing through the micropores of the second membrane 42.

It is preferred that a different kind of membrane from the first membrane 38 is used for the second membrane 42. For example, the second membrane 42 can differ in material, surface property (such as hydrophobicity and hydrophilicity), surface roughness, dimension and density of the micropores, and the like from the first membrane 38. As one embodiment, as the first membrane 38, a membrane having an excellent performance of suppressing movement of the plating additive that can be included in the plating solution Ps can be used, and as the second membrane 42, a membrane having an excellent flow feature of the gas bubbles, to which the gas bubbles Bu are difficult to attach, can be used. The average diameter of the micropores of the second membrane 42 may have a size larger than the average diameter of the micropores of the first membrane 38.

Examples of the size of the average diameter of the micropores of the second membrane 42 include a value selected from a range of several tens of nm to several hundreds of nm (to give an example of this, for example, a value selected from a range of 10 nm to 300 nm). The surface roughness of the second membrane 42 is preferably small in a point that the gas bubbles Bu become difficult to attach. It is preferable to be a case where the surface of the second membrane 42 is hydrophilic in a point that the gas bubbles Bu become more difficult to attach than a case where the surface of the second membrane 42 is hydrophobic (generally, the gas bubbles Bu are hydrophobic). Examples of specific product names of the second membrane 42 include, for example, "Electrolytic Diaphragm For Plating" manufactured by Yuasa Membrane Systems Co., Ltd.

In the plating module 400 according to this embodiment, two kinds of ion permeable membranes that are the first membrane 38 and the second membrane 42 are used. Depending on the kinds of membranes, ion permeability, permeability of an additive, adherability of gas bubbles, and the like are each different, and with only one kind of membrane, it is difficult to fulfill a preferable function in the plating module 400 in some cases. Therefore, in the plating module 400 according to this embodiment, by using the two kinds of ion permeable membranes having different properties, improvement in the overall function of the plating module 400 can be ensured.

With reference to FIG. 3, FIG. 9, and FIG. 10, the second membrane 42 includes inclined portions 42*b* that incline relative to the horizontal direction and incline so as to be positioned upward as heading from the center side of the anode chamber 11 to the outer edge of the anode chamber 11.

Specifically, the second membrane 42 according to this embodiment includes the above-described inclined portions 42*b* and an extending portion 42*a* that extends in the horizontal direction. The inclined portions 42*b* extend from the extending portion 42*a* as a starting point to one side (X-direction side) and the other side (−X-direction side) in directions away from the extending portion 42*a* and incline so as to be positioned upward as separating from the extending portion 42*a*. As a result, the second membrane 42 according to this embodiment has a "V-shaped" appearance shape in the front view (when viewed from the Y-direction).

To give an example of an inclination angle relative to the horizontal direction of the inclined portions 42*b* of the second membrane 42, for example, a value of 2 degrees or more can be used as the inclination angle, and specifically, a value of 2 degrees or more and 45 degrees or less can be used.

An outer edge of the inclined portion 42*b* according to this embodiment has an arc shape. Specifically, the outer edge of the inclined portion 42*b* has an arc shape in which parts of the outer edge are connected to both ends of the extending portion 42*a* (the end portion on the Y-direction side and the end portion on the −Y-direction side). As a result, the second membrane 42 has an approximately circular shape in the top view. The inclined portions 42*b* of the second membrane 42 according to this embodiment are approximately parallel to the inclined portions 41*b* of the first membrane 38.

The extending portion 42*a* extends in the horizontal direction (Y-direction as an example) while passing through the center of the anode chamber 11. The extending portion 42*a* is configured of a surface having a predetermined width (length in the X-direction). The extending portion 42*a* is bonded on the lower surface of a first portion 44*a* described later of the second supporting member 44.

The lower surface of the inclined portion 42*b* of the second membrane 42 is preferably smoother than the lower surface of the inclined portion 41*b* of the first membrane 38. In other words, the surface roughness (Ra) of the lower surface of the inclined portion 42*b* of the second membrane 42 is preferably smaller than the surface roughness (Ra) of the lower surface of the inclined portion 41*b* of the first membrane 38. With this configuration, the gas bubbles Bu can be effectively moved along the lower surfaces of the inclined portions 42*b* of the second membrane 42. This can effectively suppress deterioration of the plating quality of the substrate Wf due to the gas bubbles Bu.

The second supporting member 44 is a member for supporting the second membrane 42. Specifically, the second supporting member 44 includes the first portion 44*a* that supports the extending portion 42*a* of the second membrane 42 and a second portion 44*b* that supports the outer edges of the inclined portions 42*b* of the second membrane 42. The first portion 44*a* extends in the horizontal direction. Specifically, the first portion 44*a* extends in the horizontal direction (Y-direction as an example) while passing through the center of the anode chamber 11. The second portion 44*b* is configured of a circular member and inclines so as to be positioned upward as separating from the first portion 44*a*.

As illustrated in FIG. 5 and FIG. 12, the second sealing member 46 is a sealing member arranged so as to be sandwiched between the first membrane 38 and the second supporting member 44. The third sealing member 47 is a sealing member arranged so as to be sandwiched between the second supporting member 44 and the secured position of the side wall 10*b* of the plating tank 10.

In this embodiment, the shapes of the second sealing member 46 and the third sealing member 47 are identical. Specifically, as illustrated in FIG. 12, the second sealing member 46 and the third sealing member 47 have a circular shape as a whole in the top view. The second sealing member 46 is sandwiched between the outer edges of the inclined portions 41*b* of the first membrane 38 and the second portion 44*b* of the second supporting member 44. The third sealing member 47 is sandwiched between the second portion 44*b* of the second supporting member 44 and the secured position of the side wall 10*b* of the plating tank 10.

With this embodiment as described above, the second membrane 42 as described above is included, and therefore, as illustrated in FIG. 13, even when the gas bubbles Bu are generated in the anode chamber 11, the gas bubbles Bu can be moved along the inclined portions 42*b* of the second membrane 42 using buoyancy and moved to the outer edge of the second membrane 42. This can suppress remaining of the gas bubbles Bu generated in the anode chamber 11 entirely on the lower surfaces of the first membrane 38 and the second membrane 42. As a result, deterioration of the plating quality of the substrate Wf due to the gas bubbles Bu remaining entirely on the lower surfaces of the first membrane 38 and the second membrane 42 can be suppressed.

Figure 14:
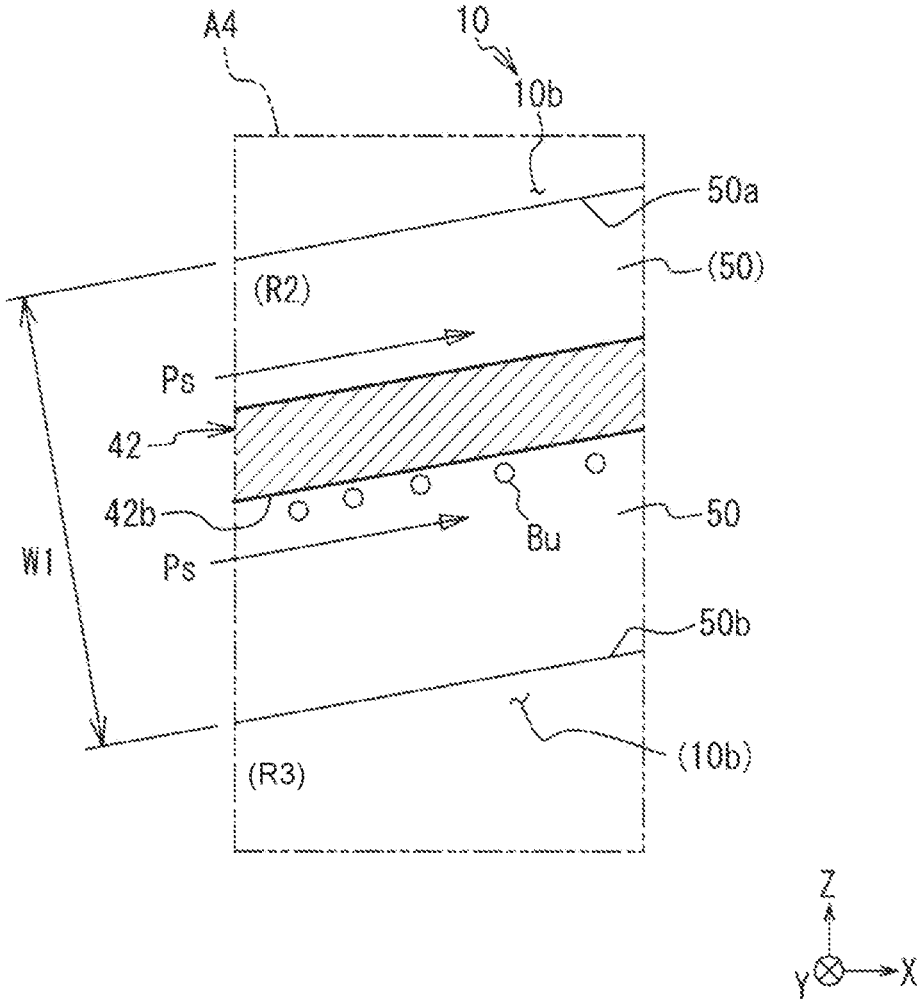
FIG. 14 is a schematic enlarged view of a part A4 in FIG. 13.

FIG. 14 is a schematic enlarged view of a part A4 of FIG. 13. With reference to FIG. 13 and FIG. 14, in the side wall 10*b* of the plating tank 10, a housing groove 50 is disposed. The housing groove 50 is formed in the side wall 10*b* of the plating tank 10 so as to be along the outer edges of the inclined portions 42*b* of the second membrane 42. Specifically, the housing groove 50 according to this embodiment is formed on the whole circumference in the circumferential direction of the side wall 10*b* so as to be along the outer edges of the inclined portions 42*b* of the second membrane 42.

The housing groove 50 is configured to temporarily house the gas bubbles Bu moved to the outer edges of the inclined portions 42*b* of the second membrane 42 and configured to cause the plating solution Ps in the third region R3 and the plating solution Ps in the second region R2 to join together in the housing groove 50.

Specifically, as illustrated in FIG. 14, the housing groove 50 according to this embodiment is formed such that an upper side groove wall 50*a* is positioned above the second membrane 42, and a lower side groove wall 50*b* opposed to the upper side groove wall 50*a* is positioned below the second membrane 42. This allows the housing groove 50 to effectively house the gas bubbles Bu moved to the outer edges of the inclined portions 42*b* along the inclined portions 42*b* of the second membrane 42 and can facilitate joining the plating solution Ps in the third region R3 and the second region R2 together in the housing groove 50.

While the distance between the upper side groove wall 50*a* and the lower side groove wall 50*b* (that is, a groove width W1) is not particularly limited, in this embodiment, a value selected from a range of 2 mm or more and 30 mm or less is used as an example.

With reference to FIG. 13, the housing groove 50 is communicated with the anode chamber discharge ports 17 described later through communication passages 51. Specifically, the communication passage 51 communicates between the upper end of the housing groove 50 and the upstream end of the anode chamber discharge port 17.

The anode chamber discharge port 17 is communicated with the housing groove 50 via the communication passage 51 disposed in the side wall 10*b* of the plating tank 10. The anode chamber discharge port 17 is configured to suction the plating solution Ps in the third region R3 and the plating solution Ps in the second region R2 together with the gas bubbles Bu housed in the housing groove 50 and discharge them to the outside of the plating tank 10.

Specifically, the anode chamber discharge port 17 according to this embodiment is communicated with a part positioned on the uppermost side of the housing groove 50 via the communication passage 51 disposed in the side wall 10*b* of the plating tank 10. At a part of the second portion 44*b* of the second supporting member 44, a groove 44*d* (or a hole may be applied) is disposed for causing the plating solution Ps in the second region R2 flowing along the upper surface of the second membrane 42 to flow into the communication passage 51. The plating solution Ps in the third region R3 and the plating solution Ps in the second region R2 flow along the second membrane 42, then join together and flow into the communication passages 51, and next, are discharged from the anode chamber discharge ports 17. Note that the total of two anode chamber discharge ports 17 according to this embodiment are disposed.

With this embodiment, the gas bubbles Bu moved to the outer edges of the inclined portions 42*b* of the second membrane 42 can be temporarily housed in the housing groove 50, and the housed gas bubbles Bu can be discharged from the anode chamber discharge ports 17 to the outside of the plating tank 10 together with the plating solution Ps in the third region R3 and the second region R2. This can effectively suppress remaining of the gas bubbles Bu on the lower surface of the second membrane 42.

With this embodiment, the gas bubbles Bu are temporarily housed in the housing groove 50, thereby allowing a plurality of small gas bubbles Bu to be joined and made into large gas bubbles Bu in the housing groove 50. This can make it easier to discharge the gas bubbles Bu from the anode chamber discharge ports 17.

As illustrated in FIG. 13, the communication passage 51 may be configured such that the cross-sectional area of the communication passage 51 decreases as heading to the downstream side. Since this configuration makes it easier for the gas bubbles Bu to temporarily remain in the housing groove 50, in the housing groove 50, the plurality of small gas bubbles Bu can be effectively joined and made into the large gas bubbles Bu. This can effectively discharge the gas bubbles Bu from the anode chamber discharge ports 17.

When the membrane module 40 includes the first membrane 38 and the second membrane 42 like this embodiment, the question is how to put the plating solution in the second region R2. The following describes this respect.

As illustrated in FIG. 3, the plating module 400 includes two pipe members 31 communicating between the first region R1 below the anode 13 in the plating tank 10 and the second region R2 between the first membrane 38 and the second membrane 42. Specifically, the pipe members 31 each include a first end 31*a* opening to the first region R1, a second end 31*b* opening to the second region R2, and a coupling member 31*c* coupling the first end 31*a* to the second end 31*b*.

The pipe member 31 is a pipe-shaped member that does not have openings other than the opening of the first end 31*a* or the opening of the second end 31*b*. The first end 31*a* is arranged in the first region R1 spaced from the upper surface of the bottom wall 10*a* of the plating tank 10 such that the plating solution accumulated in the anode chamber 11 can be put in the pipe member 31. The second end 31*b* is arranged in the second region R2 spaced from the lower surface of the first membrane 38 such that the plating solution passing through the pipe member 31 can be injected into the second region R2.

Figure 15:
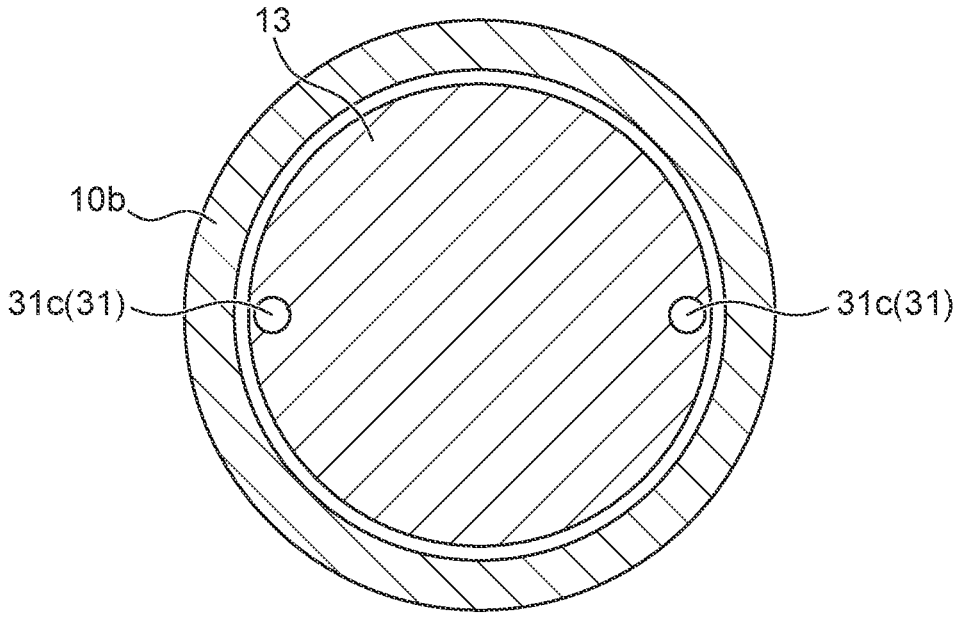
FIG. 15 is a plan view schematically illustrating an installation aspect of pipe members of the embodiment.

FIG. 15 is a plan view schematically illustrating an installation aspect of the pipe members of this embodiment. FIG. 15 only illustrates the side wall 10*b* of the plating tank 10, the pipe members 31, and the anode 13, and the members other than those are not illustrated. As illustrated in FIG. 3 and FIG. 15, the pipe members 31 are arranged to be spaced 180° from one another along the outer peripheral portion of the anode 13. The coupling member 31*c* of the pipe member 31 passes through the anode 13 and the second membrane 42 and extends linearly in the vertical direction to couple the first end 31*a* to the second end 31*b*.

Disposing the pipe member 31 can, while injecting the plating solution into the second region R2 between the first membrane 38 and the second membrane 42, restrict the gas bubbles from entering the second region R2. That is, in order to perform the plating process, it is necessary to inject the plating solution into the second region R2. In this respect, it is conceivable that the plating solution is injected from the third region R3 into the second region R2, for example, by forming a flow passage, such as a hole, in the second membrane 42. However, in this aspect, the gas bubbles generated at the anode 13 possibly enter the second region R2 from the third region R3 via the flow passage of the second membrane 42. The gas bubbles that have entered the second region R2 sometimes attach to the lower surface of the first membrane 38 and remain there. Then, due to the gas bubbles remaining on the lower surface of the first membrane 38, the plating quality of the substrate possibly deteriorates.

In contrast, the pipe members 31 communicate between the first region R1, where the gas bubbles at the anode 13 are less likely to exist, and the second region R2 in this embodiment. Accordingly, as the plating solution is supplied from the anode chamber supply port 16, the plating solution not including the gas bubbles of the first region R1 is injected into the second region R2 through the pipe members 31. As a result, the second region R2 can be filled with the plating solution not including the gas bubbles, thereby ensuring suppressed deterioration of the plating quality of the substrate due to the gas bubbles at the anode 13.

Note that, while the above-described embodiment has described the example where the two pipe members 31 are arranged to be spaced 180° From one another, the number of the pipe members 31 and arrangement of the pipe members 31 are arbitrary. While the above-described embodiment has described the example where the pipe member 31 including the coupling member 31*c* passing through the anode 13 is provided, the configuration is not limited to this.

Figure 16:
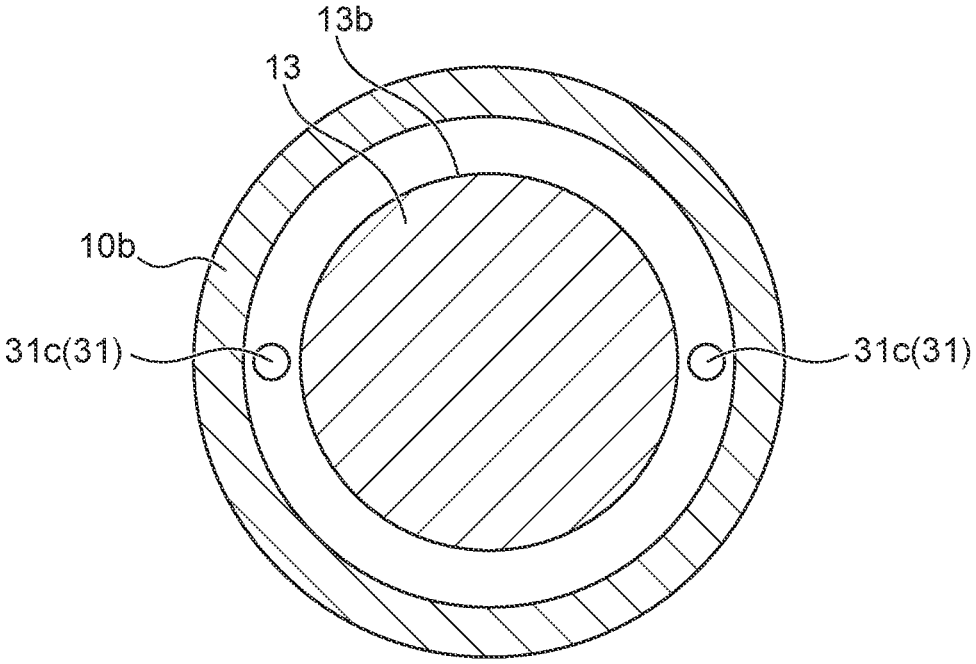
FIG. 16 is a plan view schematically illustrating an arrangement aspect of the pipe members of a modification example.

FIG. 16 is a plan view schematically illustrating an arrangement aspect of the pipe members in a modification. FIG. 16 only illustrates the side wall 10*b* of the plating tank 10, the pipe members 31, and the anode 13, and the members other than those are not illustrated. As illustrated in FIG. 16, the coupling members 31*c* of the pipe member 31 may be configured to couple the first end 31*a* to a second end 32*a* by passing between a side wall 13*b* of the circular-plate shaped anode 13 and the side wall 10*b* of the plating tank 10. With this modification, since it is not necessary to pass the pipe members 31 through the anode 13 for installation, the plating module 400 can be easily assembled.

Figure 17:
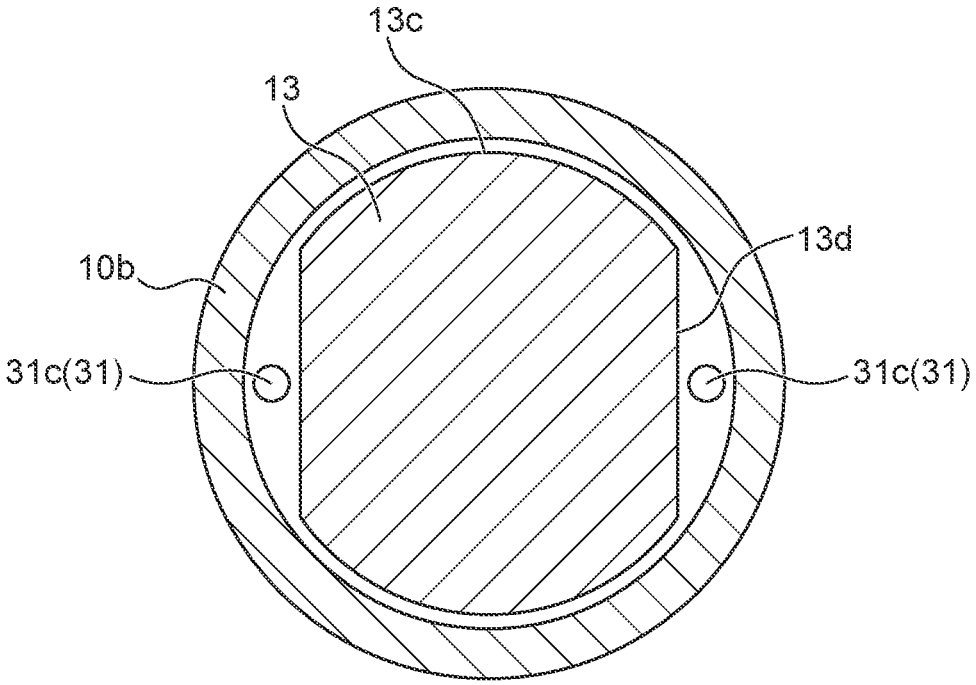
FIG. 17 is a plan view schematically illustrating an arrangement aspect of the pipe members of a modification example.

FIG. 17 is a plan view schematically illustrating an arrangement aspect of the pipe members of a modification. FIG. 17 only illustrates the side wall 10*b* of the plating tank 10, the pipe members 31, and the anode 13, and the members other than those are not illustrated. As illustrated in FIG. 17, the anode 13 is not limited to having a circular-plate shape. Specifically, the anode 13 may include a first side wall 13*c* in a shape that corresponds to the side wall 10*b* of the plating tank 10 and a second side wall 13*d* spaced further from the side wall 10*b* of the plating tank 10 than the first side wall 13*c* is.

In this modification, the first side wall 13*c* is a circular-shaped side wall corresponding to the cylindrical-shaped side wall 10*b* of the plating tank 10, and the second side wall 13*d* is a linear-shaped side wall. The coupling member 31*c* of the pipe member 31 may be configured to couple the first end 31*a* to the second end 31*b* passing between the second side wall 13*d* of the anode 13 and the side wall 10*b* of the plating tank 10. With this modification, since it is not necessary to pass the pipe members 31 through the anode 13 for installation, the plating module 400 can be easily assembled. Furthermore, with this modification, the area of the anode 13 can be increased to accelerate the plating process without increasing the size of the side wall 10*b* of the plating tank 10.

The pipe member 31 can be modified differently from the modifications illustrated in FIG. 16 and FIG. 17 as long as it is a tubular member communicating between the first region R1 and the second region R2. That is, the pipe member 31 is only necessary to include the first end 31*a* opening to the first region R1, the second end 31*b* opening to the second region R2, and the coupling member 31*c* coupling the first end 31*a* to the second end 31*b*, and the coupling member 31*c* may, for example, pass through the inside of the plating tank 10 or may pass through the outside of the plating tank 10.

Several embodiments of the present invention have been described above in order to facilitate understanding of the present invention without limiting the present invention. The present invention can be changed or improved without departing from the gist thereof, and obviously, the equivalents of the present invention are included in the present invention. It is possible to arbitrarily combine or omit respective constituent elements described in the claims and specification in a range in which at least a part of the above-described problems can be solved, or a range in which at least a part of the effects is exhibited.

As one embodiment, this application discloses a plating apparatus that includes: a plating tank configured to house a plating solution; an anode arranged in the plating tank; a substrate holder configured to hold a substrate with a surface to be plated facing downward so as to be opposed to the anode; a membrane module that includes a first membrane partitioning an inside of the plating tank into an anode chamber and a cathode chamber and a second membrane arranged between the first membrane and the anode; and a pipe member communicating between a first region below the anode in the plating tank and a second region between the first membrane and the second membrane.

Furthermore, as one embodiment, this application discloses a plating apparatus in which the pipe member includes a first end opening to the first region, a second end opening to the second region, and a coupling member passing through the anode and coupling the first end to the second end.

Furthermore, as one embodiment, this application discloses a plating apparatus in which the pipe member includes a first end opening to the first region, a second end opening to the second region, and a coupling member passing between a side wall of the anode and a side wall of the plating tank and coupling the first end to the second end.

Furthermore, as one embodiment, this application discloses a plating apparatus in which the anode includes a first side wall and a second side wall. The first side wall is in a shape corresponding to a side wall of the plating tank. The second side wall is spaced further from the side wall of the plating tank than the first side wall, and the pipe member includes a first end opening to the first region, a second end opening to the second region, and a coupling member passing between the second side wall of the anode and the side wall of the plating tank and coupling the first end to the second end.

Furthermore, as one embodiment, this application discloses a plating apparatus in which the first end is arranged in the first region spaced from a bottom wall of the plating tank, and the second end is arranged in the second region spaced from the first membrane.

Furthermore, as one embodiment, this application discloses a plating apparatus in which the first membrane is a membrane configured to allow ion species included in a plating solution to pass through and prevent a plating additive included in the plating solution from passing through, and the second membrane is a membrane configured to allow ion species included in the plating solution to pass through and prevent gas bubbles from passing through.

Furthermore, as one embodiment, this application discloses a plating apparatus in which the plating tank includes an anode chamber supply port for supplying a plating solution to the anode chamber and an anode chamber discharge port for discharging the plating solution from the anode chamber to an outside of the plating tank.

REFERENCE SIGNS LIST

10 . . . plating tank
10*a* . . . bottom wall
10*b* . . . side wall
11 . . . anode chamber
12 . . . cathode chamber
13 . . . anode
13*b* . . . side wall
16 . . . anode chamber supply port
17 . . . anode chamber discharge port
20 . . . substrate holder
31 . . . pipe member
31*a* . . . first end
31*b* . . . second end
31*c* . . . coupling member
40 . . . membrane module
38 . . . first membrane
42 . . . second membrane
400 . . . plating module

1000 . . . plating apparatus
Wf . . . substrate
R1 . . . first region
R2 . . . second region
Ps . . . plating solution

The invention claimed is:

1. A plating apparatus comprising:

a plating tank configured to house a plating solution;

an anode arranged in the plating tank;

a substrate holder configured to hold a substrate with a surface to be plated facing downward so as to be opposed to the anode;

a membrane module that includes a first membrane partitioning an inside of the plating tank into an anode chamber and a cathode chamber and a second membrane arranged between the first membrane and the anode; and a pipe member communicating between a first region between the anode and a bottom wall of the plating tank and a second region between the first membrane and the second membrane.

2. The plating apparatus according to claim 1, wherein the pipe member includes a first end opening to the first region, a second end opening to the second region, and a coupling member passing through the anode and coupling the first end to the second end.

3. The plating apparatus according to claim 1, wherein the pipe member includes a first end opening to the first region, a second end opening to the second region, and a coupling member passing between a side wall of the anode and a side wall of the plating tank and coupling the first end to the second end.

4. The plating apparatus according to claim 1, wherein the anode includes a first side wall and a second side wall, the first side wall being in a shape corresponding to a side wall of the plating tank, the second side wall being spaced further from the side wall of the plating tank than the first side wall, and the pipe member includes a first end opening to the first region, a second end opening to the second region, and a coupling member passing between the second side wall of the anode and the side wall of the plating tank and coupling the first end to the second end.

5. The plating apparatus according to claim 1, wherein the first end is arranged in the first region spaced from a bottom wall of the plating tank, and the second end is arranged in the second region spaced from the first membrane.

6. The plating apparatus according to claim 1, wherein the first membrane is a membrane configured to allow ion species included in a plating solution to pass through and prevent a plating additive included in the plating solution from passing through, and the second membrane is a membrane configured to allow ion species included in the plating solution to pass through and prevent gas bubbles from passing through.

7. The plating apparatus according to claim 1, wherein the plating tank includes an anode chamber supply port for supplying a plating solution to the anode chamber and an anode chamber discharge port for discharging the plating solution from the anode chamber to an outside of the plating tank.

* * * * *